US006378312B1

(12) United States Patent
Wang

(10) Patent No.: US 6,378,312 B1
(45) Date of Patent: Apr. 30, 2002

(54) PULSE-TUBE CRYOREFRIGERATION APPARATUS USING AN INTEGRATED BUFFER VOLUME

(75) Inventor: Chao Wang, Syracuse, NY (US)

(73) Assignee: Cryomech Inc., Syracuse, NY (US)

( * ) Notice: Subject to any disclaimer, the term of this patent is extended or adjusted under 35 U.S.C. 154(b) by 0 days.

(21) Appl. No.: 09/579,148

(22) Filed: May 25, 2000

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS

| | | | | | |
|---|---|---|---|---|---|
| 3,128,605 | A | | 4/1964 | Malaker et al. | 62/6 |
| 3,237,421 | A | | 3/1966 | Gifford | 62/88 |
| 3,421,331 | A | * | 1/1969 | Webb | 62/6 |
| 3,625,015 | A | * | 12/1971 | Chellis | 62/6 |
| 3,640,082 | A | * | 2/1972 | Dehne | 62/6 |
| 4,498,296 | A | * | 2/1985 | Dijkstra et al. | 62/6 |
| 4,858,441 | A | * | 8/1989 | Wheatley et al. | 62/6 |
| 4,967,572 | A | * | 11/1990 | Strasser | 62/6 |
| 5,032,772 | A | * | 7/1991 | Gully et al. | 62/6 |
| 5,107,683 | A | * | 4/1992 | Chan et al. | 62/6 |
| 5,275,002 | A | * | 1/1994 | Inoue et al. | 62/6 |
| 5,412,952 | A | | 5/1995 | Ohtani et al. | 62/6 |
| 5,488,830 | A | | 2/1996 | Burt | 62/6 |
| 5,701,742 | A | * | 12/1997 | Eckels et al. | 62/6 |
| 5,711,156 | A | | 1/1998 | Matsui et al. | 62/6 |
| 5,787,712 | A | | 8/1998 | Fukui et al. | 62/6 |
| 5,794,450 | A | | 8/1998 | Alexander | 62/6 |
| 5,901,737 | A | | 5/1999 | Yaron | 137/246.12 |
| 2001/0015068 | A1 | | 8/2001 | Chung et al. | 62/6 |

FOREIGN PATENT DOCUMENTS

| | | |
|---|---|---|
| EP | 0 614 059 A1 | 3/1994 |
| FR | 2 736 710 | 7/1995 |
| GB | 2 318 176 A | 5/1996 |

* cited by examiner

*Primary Examiner*—Ronald Capossela
(74) *Attorney, Agent, or Firm*—Brown & Michaels PC

(57) ABSTRACT

A component for use in pulse tube cryorefrigerators which integrates the reservoirs (buffer volumes) as well as the housing for the rotary valve and valve plate and drive motor into a convenient, unified assembly. Other components required by the pulse-tube refrigerators, such as the heat sink, orifices, phase shifting valves, connecting tubing, etc., may also be integrated into the buffer volume/valve/motor housing within the teachings of the invention.

37 Claims, 6 Drawing Sheets

PULSE-TUBE CRYOREFRIGERATION APPARATUS USING AN INTEGRATED BUFFER VOLUME

BACKGROUND OF THE INVENTION

1. Field of the Invention

The invention pertains to the field of cryorefrigeration. More particularly, the invention pertains to an integrated component for a pulse tube cryorefrigerator.

2. Description of the Related Art

Typical closed-cycle expansion cryogenic refrigerators include the Stirling, Gifford-McMahon and pulse tube types, all of which provide cooling through the alternating compression and expansion of a cryogen, with a consequent reduction of its temperature. Stirling and Gifford-McMahon regenerative refrigerators use displacers to move a cryogen (usually helium) through their regenerators, exhaust the heat in the return gas to the compressor package. The noise and vibration induced by the displacer creates problems, and the wear of the seals on the displacer require periodic maintenance and replacement.

Therefore, it is highly desirable to invent cryorefrigeration devices that generate less vibration and less acoustic noise than prior art cryorefrigerators. It is also desirable to decrease the number of moving parts used in cryorefrigeration devices and to significantly increase the required maintenance intervals.

Pulse tube refrigerators are a known alternative to the Stirling and Gifford-McMahon types, which do not use a mechanical displacer.

A pulse tube is essentially an adiabatic space wherein the temperature of the working fluid is stratified, such that one end of the tube is warmer than the other. A pulse tube refrigerator operates by cyclically compressing and expanding a cryogen in conjunction with its movement through heat exchangers. Heat is removed from the system upon the expansion of the cryogen in the gas phase.

Prior art single-stage valved pulse tube cryorefrigerators generally include a pulse tube, a rotary valve to generate the oscillating compression-expansion cycle, a reservoir to contain the expanding cryogen gas, orifices for the movement and phasing of the gas between the reservoir or buffer volume and the rest of the system, and a regenerator for absorbing heat temporarily and reversibly. Single stage pulse tube cryorefrigerators are generally capable of reaching temperatures above 20° K., and achieving lower temperatures has in the past required staging of the pulse tubes. U.S. Pat. No. 3,237,421 to Gifford and other prior art publications disclose multistage pulse tube cryorefrigerators.

Prior art two-stage pulse tube cryorefrigerators generally include, in addition to the foregoing components, a first-stage pulse tube, a first-stage regenerator, a second-stage pulse tube, a second-stage regenerator and first and second cooling stages.

Although an improvement over mechanical displacement devices, prior art pulse tube cryorefrigerators were ungainly arrangements of separate components, which leads to inefficiency and difficulty in manufacture and maintenance.

Pulse tube coolers can be employed in a wide variety of applications from civilian to government to military. Most of the applications below are dependent on the availability of a cheap cryocooler with a long life—long life is a unique advantage of the pulse tube cooler.

Sensors: Infrared; atmospheric studies, thermal losses, pollution monitoring, process monitoring, night vision, missile guidance, missile surveillance, Gamma-ray, monitor nuclear activity Semiconductors in computers: (large speed gain at small cost penalty, temperatures around 100—200 K.)

Hi-Tc superconductors: Cellular phone base stations (more channels, temperatures under 80 K.), High speed computers, SQUID magnetometers, heart and brain studies Magnets: maglev trains, mine sweeping Cryopumps for the semiconductor industry Cryogenic catheters, Cryosurgery Liquefaction of gases: Helium, Hydrogen, Neon, Nitrogen, Argon Oxygen, Natural Gas, etc.—remote wells or peak shaving (providing extra gas at peak loads to minimize steady pipeline capacity) or for fleet vehicles Perhaps the application of cryorefrigeration which is most familiar to the public is its use in Magnetic Resonance Imaging (hereinafter "MR"). MRI is an imaging technique used widely within the medical field to produce high quality images of the inside of a human body.

Generally, the most expensive component of a MRI system is the imaging magnet, which is typically an electromagnet made from a superconducting material. When cooled to a temperature near absolute zero (i.e., −273.15° C. or 0° K.), the superconducting wire in the magnet's coil has an electrical resistance approaching zero. Therefore, MRI imaging magnets are usually maintained at a temperature of 4.2° K. using liquid helium.

Typically, the main superconducting coils of a MRI imaging magnet are enclosed in a pressure vessel contained within an evacuated vessel (i.e., Dewar vessel), and superconducting temperatures are obtained by boiling a liquid cryogen, such as liquid helium, within the pressure vessel. Because distribution, storage and handling of liquid helium is difficult and costly, mechanical displacement cryorefrigerators, such as the Gifford-McMahon type, typically are used to condense and recycle the helium gas generated by boiling the liquid cryogen.

One problem associated with cryorefrigerators using displacers is that the motion of the displacer creates a series of repetitive knocking sounds and mechanical vibrations, which become especially rapid as the magnet in the MRI is cycled on and off to generate the magnetic field gradients that are used to collect information regarding the molecular structure of a patient's body. The MRI equipment thus generates high acoustic noise levels, and also vibrates. Because of the volume of this noise, it is recommended that patients undergoing MRI use hearing protection devices. In fact, some MRI imaging sites even go to such lengths as to provide an airplane-like audio headphone system for their patients, in order to protect their hearing and mask the acoustic noise, which may agitate or frighten the patient.

SUMMARY OF THE INVENTION

The present invention is a component for use in pulse tube cryorefrigerators which integrates one or more of the reservoirs (buffer volumes) as well as the housing for the rotary valve and valve plate and drive motor into a convenient, unified assembly. Other components required by the pulse-tube refrigerators, such as the heat sink, orifices, phase shifting valves, connecting tubing, etc., may also be integrated into the buffer volume/valve/motor housing within the teachings of the invention.

Cryorefrigerators using the novel component have increased efficiency, reduced manufacturing cost, and increased compatibility with varied cryostats due to the compactness of the component.

DETAILED DESCRIPTION OF THE INVENTION

The invention is component for a single, double or multiple-stage pulse tube cryorefrigeration apparatus which integrates a number of the parts into a single housing, and cryorefrigerators using the component. The overall system using the component may be used as a stand alone cryorefrigerator or in a cryostat in conjunction with a larger cryorefrigeration system.

Figure 1:
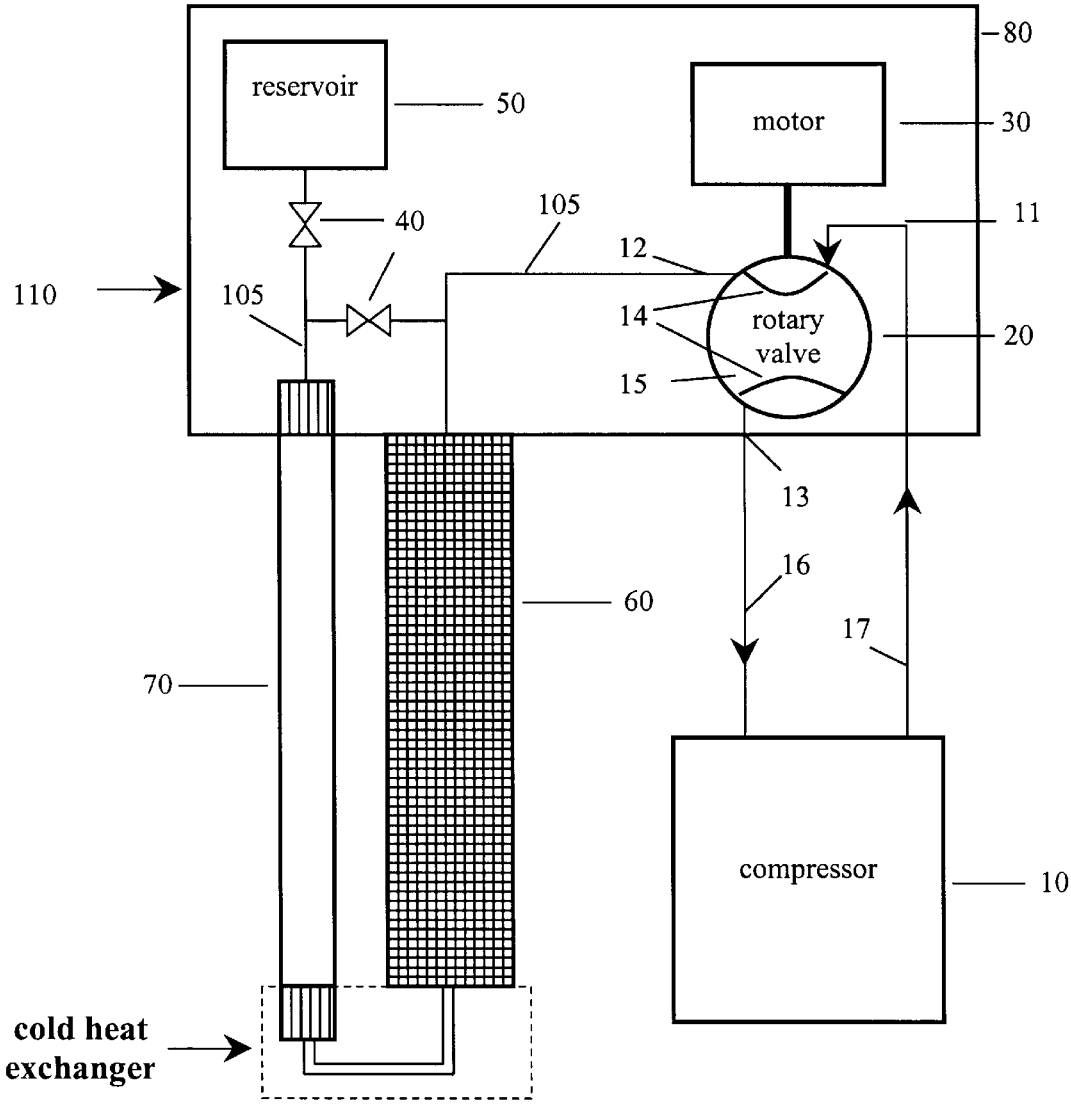
FIG. 1 shows a block diagram of a single-stage cryorefrigeration apparatus of the present invention.

Referring to FIG. 1, a single-stage cryorefrigeration apparatus of the invention includes a rotary valve 20 or other devices for controlling pressure oscillation, the actuator for the valve 20, shown here as motor 30, and a reservoir or buffer volume 50, all integrated within housing 80, thereby forming a single integrated unit. Flow channels 105 connect the orifices 40, valve 14, reservoir 50 and external components 60 and 70.

The integrated motor housing and reservoir is made from any suitable material capable of withstanding high pressure (i.e., greater than 300 psig), such as machined aluminum, copper, bronze, brass or stainless steel. In a preferred embodiment, the housing is machined from a single block of 6061-T6 aluminum.

The single stage pulse tube cryorefrigerator is a simple heat pump that pumps heat from a cooling load (not shown) to a heat sink 110, and thus to the ambient environment. Compressor 10, typically a piston type compressor, delivers cryogen under pressure to the pressure oscillation controller, such as, for example, a rotary valve 20 rotated by motor 30. Housing 80, which optionally serves as a heat sink 110, integrates pressure oscillation controlling means 20, its power source 30, and reservoir 50 into a single unit, with the parts connected by flow channels 105. Preferably, the orifices 40 are also integrated into the housing 80

In operation, compressor 10 delivers cryogen (usually helium) under pressure to pressure oscillation controlling means 20, thereby causing an alternating mass flow throughout the pulse tube refrigerator. As shown in FIG. 1, as the rotary valve 20 rotates, the bores 14 through the body 15 of the rotary valve 20 alternately connect the regenerator inlet connection 12 to the pressurized cryogen inlet 11 connected to the compressor 10 output line 17 (the valve is shown in this position), and to the lower pressure cryogen outlet 13 connected to the compressor 10 return line 16. The alternating pressure and mass flow produced by compressor 10 and pressure oscillator 20 constitutes pressure/volume (PV) work, causing regenerator 60 to pump heat from the cooling load to the heat sink, where the heat is ultimately rejected. The result of this heat pumping action is to lower the temperature of the cooling load. Meanwhile, the PV work travels down pulse tube 70, where it is rejected as heat to the heat sink.

Regenerator 60 is typically filled with a stack of screens which acts as a thermal sponge, alternately absorbing heat from the cryogen and rejecting the absorbed heat back to the cryogen as the pressure oscillates. Pulse tube 70 is a thin-walled tube of a lower thermal conductivity material, such as stainless steel. Pulse tube 70 has screen regions, preferably of copper, at both the hot and cold ends. The two screen regions typically are thermally connected to copper blocks to form the cold and hot end heat exchangers of the pulse tube.

Figure 4A:
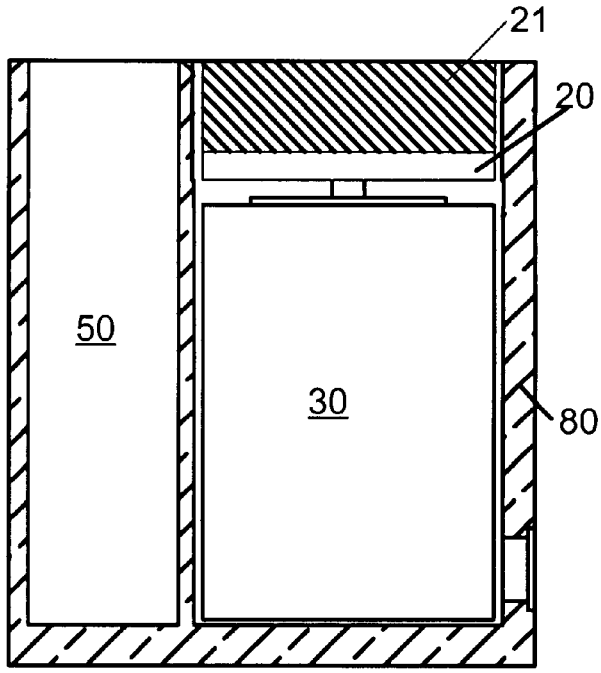
FIGS. 4*a* and 4*b* show side cut-away and top drawings, respectively, of an integrated pressure control housing and buffer volume, for use in a single-stage cryorefrigerator.
Figure 4B:
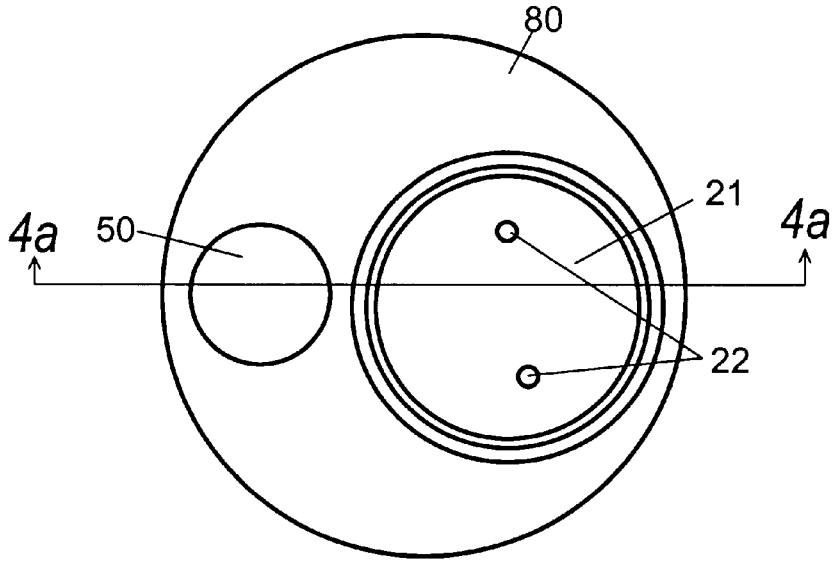

FIGS. 4*a* and 4*b* show a side cut-away and top view, respectively, of the integrated buffer volume and pressure control housing 80 of the single-stage embodiment of the invention. The motor 30 mounts within a motor chamber, and the valve 20 is connected to the motor shaft. A valve disk 21 is attached to the valve 20, with gas passage holes 22 allowing gas to pass through the valve body 20 and disk 21. The section above the housing 80 is not shown, but would be mounted above the housing 80 in this figure, so that gas from the valve disk 21 holes 22 would pass to and from that section.

Figure 2:
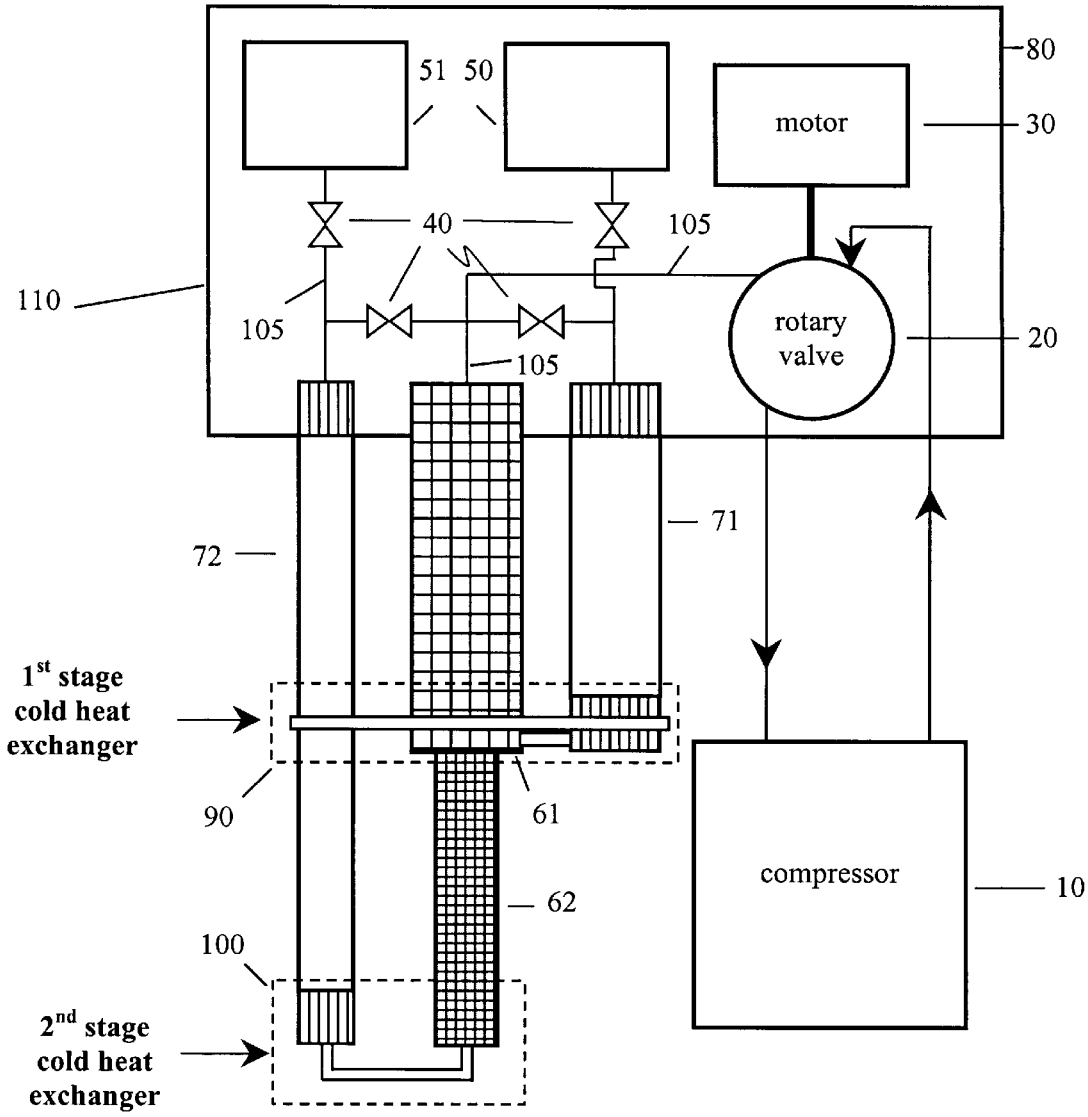
FIG. 2 shows a block diagram of a two-stage cryorefrigeration apparatus of the present invention.

Referring to FIG. 2, a two-stage cryorefrigeration apparatus of the invention includes a first cooling stage 90 and a second cooling stage 100, the first cooling stage 90 having a first stage temperature which is higher than a second stage temperature of the second cooling stage 100. The two-stage cryorefrigerator includes a rotary valve 20 and motor 30 for controlling pressure oscillation, and a primary reservoir 50 and a secondary reservoir 51, all integrated within housing 80. Thus, housing 80 integrates the housing for pressure oscillation means 20 and its power source 30 with the reservoirs 50 and 51, thereby forming a single integrated unit. Optionally, the secondary reservoir 51 is externally located, as will be discussed below.

The integrated motor housing and reservoir is made from any suitable material capable of withstanding high pressure (i.e., greater than 300 psig). As in the single-stage embodiment, these materials include copper, brass, bronze, stainless steel or aluminum, and in a preferred embodiment preferably 6061-T6 aluminum.

In addition to the components of the single-stage pulse tube cryorefrigerator, the two-stage cryorefrigeration apparatus of the invention includes first and second stage regenerators 61 and 62, and first and second stage pulse tubes 71 and 72.

The lower-temperature second stage pulse tube 72 is connected in series or parallel with the cold end of first stage pulse tube 71. In operation, compressor 10 supplies a continuous pressure wave to first stage regenerator 61. After providing cooling in the first stage regenerator 61, the pressure wave provides further cooling in second stage regenerator 62, with the cold end of second stage second stage pulse tube 72 being in thermal contact with the cooling load (not shown). The pressure wave continues through the two pulse tubes 71 and 72, and the PV work is rejected as heat to the heat sink.

Figure 3:
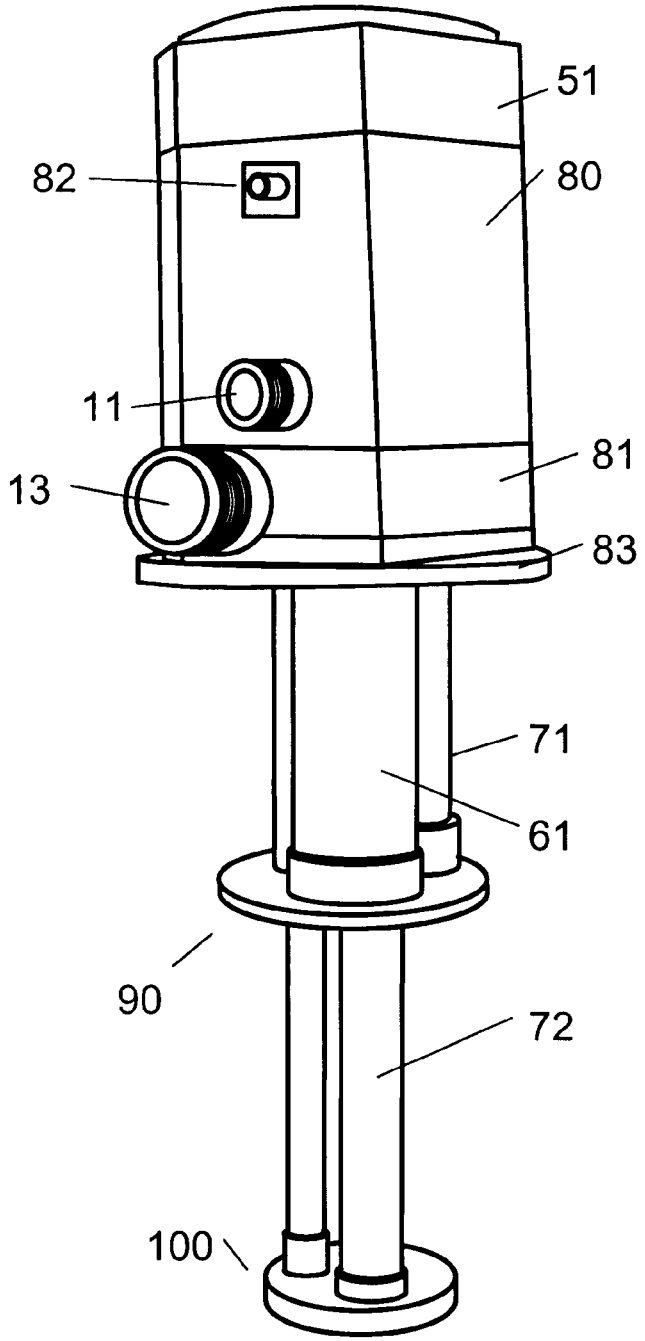
FIG. 3 shows a perspective view of a cryorefrigerator of the invention.
Figure 5A:
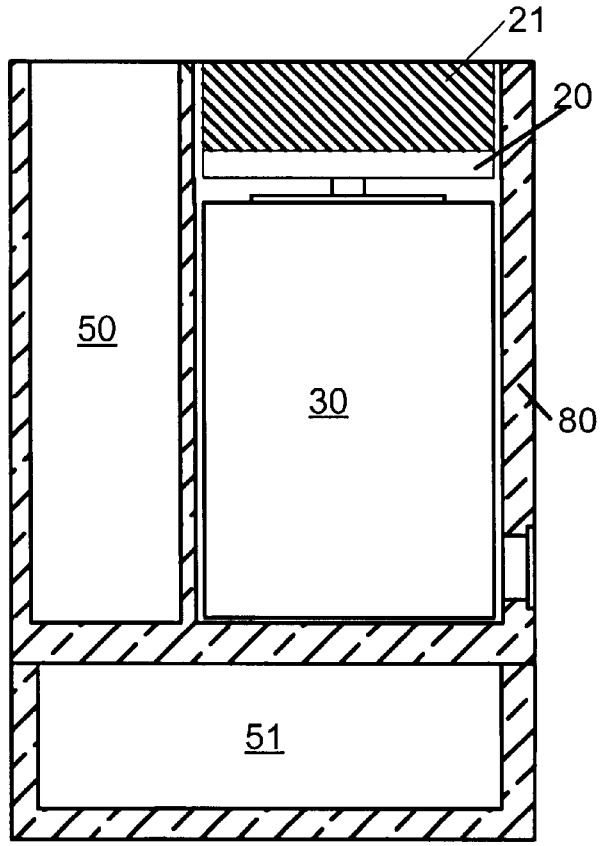
FIGS. 5*a* and 5*b* show side cut-away and top drawings, respectively, of an integrated pressure control housing and buffer volume with an integrated secondary buffer volume, for a two-stage cryorefrigerator.
Figure 5B:
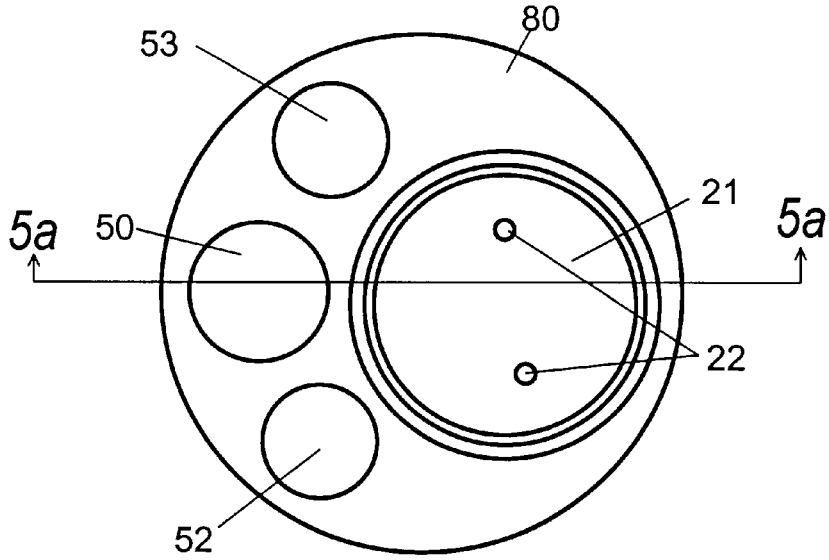

FIG. 3 shows a perspective view of the cryorefrigerator of the invention, in a two-stage embodiment corresponding to the cut-away and top drawings of FIGS. 5*a* and 5*b*. At the top is the secondary buffer volume 51 housing, which is mounted to the integrated pressure control/buffer volume housing 80. The inlet 11 for refrigerant gas and electrical connector 82 for the pressure control extend from the side of housing 80. A lower section 81 provides connection to the gas outlet 13. The pulse tube 71 and 72 and regenerators 61 and 62 extend below the lower section 81. A flange 83 allows the lower part of the cryorefrigerator (pulse tubes and regenerators) to be suspended within a vacuum tank for insulation (not shown).

Referring to FIGS. 5*a* and 5*b*, the cutaway view of FIG. 5*a* is shown inverted relative to the complete view of FIG. 3, so that the secondary buffer volume 51 is on the bottom. It can be seen that the secondary reservoir or buffer volume 51 is mounted to the housing 80, with a gas-tight joint. The motor 30 mounts within a motor chamber, and the valve 20 is connected to the motor shaft. A valve disk 21 is attached to the valve 20, with gas passage holes 22 allowing gas to pass through the valve body 20 and disk 21. The lower section 81 is not shown, but would be mounted above the housing 80 in this figure, so that gas from the valve disk 21 holes 22 would pass to and from the lower section 81.

FIG. 5*b* also shows that additional buffer volumes 52 and 53 could be optionally be incorporated into the primary housing 80, for use in two-stage, three-stage or higher embodiments. Also, although the buffer volumes 50, 52 and 53 are shown as round bores in the housing 80, it will be understood by one skilled in the art that the buffer volumes could be oval, rectangular, or any regular or irregular shape desired, depending on the volume needed and the configuration of the motor/valve chambers and other elements incorporated into the housing.

Figure 6A:
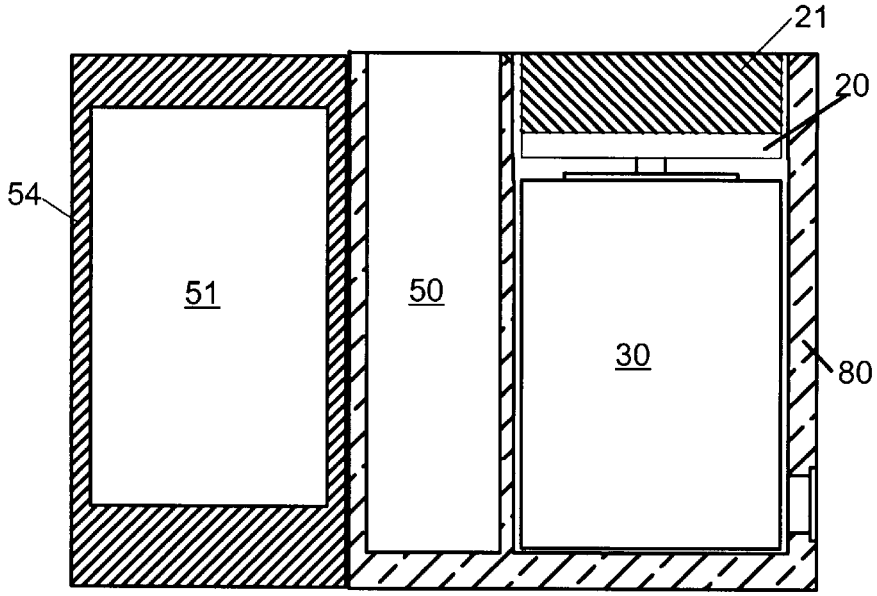
FIGS. 6*a* and 6*b* show side cut-away and top drawings, respectively, of an integrated pressure control housing and buffer volume, with an external secondary buffer volume, for use in a two-stage cryorefrigerator.
Figure 6B:
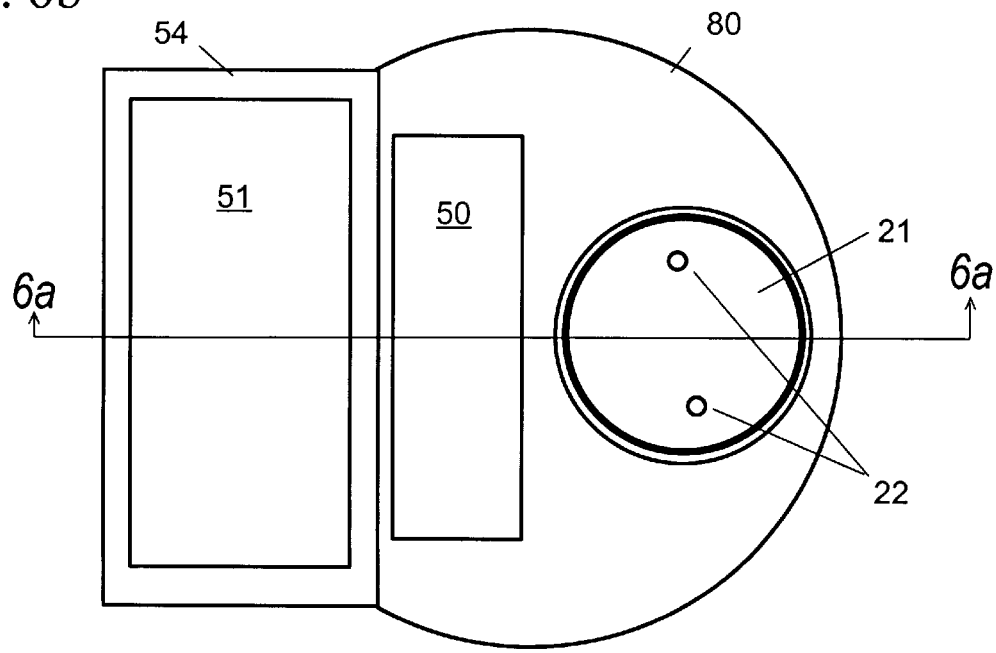

FIGS. 6*a* and 6*b* show an alternate housing for a two-stage cryorefrigerator. The parts are all as described for the embodiment of FIGS. 3, 5*a* and 5*b*, with the exception that the secondary reservoir 51 is contained in a separate housing 54 mounted to the side of the main housing 80, instead of to the end of the housing 80 as shown in the embodiment of FIGS. 5*a* and 5*b*. In FIG. 6*b*, it is seen that primary buffer volume 50 can be rectangular in shape, although as discussed above, the shape might vary widely within the teachings of the invention, depending on the specific needs of the embodiment.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A cryorefrigeration apparatus of the kind having at least one cooling tube, a oscillation controller coupled to a cooling gas supply and exhaust to generate an oscillating compression-expansion cycle, at least one reservoir to contain an expanding cryogen gas, at least one orifice for the movement and phasing of the gas to and from the reservoir, and a regenerator for absorbing heat temporarily and reversibly, comprising:

an integrated pressure oscillation controller and buffer volume housing coupled to the at least one cooling tube, the regenerator, and the cooling gas supply and exhaust, comprising a body having a chamber therein containing the pressure oscillation controller and at least one other chamber forming the at least one reservoir.

2. The cryorefrigeration apparatus of claim 1, in which the cooling tube comprises at least one pulse tube.

3. The cryorefrigeration apparatus of claim 1, in which there are at least a first reservoir and a second reservoir contained within the body of the housing.

4. The cryorefrigeration apparatus of claim 1, in which there are at least a first reservoir and a second reservoir, and wherein at least one of the first reservoir and second reservoirs is contained in the body, and the other is external to the body in gas-tight communication therewith.

5. The cryorefrigeration apparatus of claim 1, in which the pressure oscillation controller comprises a rotary valve rotated by a motor.

6. The cryorefrigeration apparatus of claim 5, in which the rotary valve is in a valve chamber in the body.

7. The cryorefrigeration apparatus of claim 5, in which the motor is in a motor chamber in the body.

8. The cryorefrigeration apparatus of claim 1, in which the buffer volume housing further comprises at least one orifice in close proximity to at least one reservoir.

9. The cryorefrigeration apparatus of claim 8, in which the buffer volume housing further comprises at least one flow channel connecting the orifice to at least one reservoir.

10. The cryorefrigeration apparatus of claim 1, in which the buffer volume housing further comprises at least one flow channel connecting at least one reservoir to the pressure oscillation controller.

11. An integrated pressure oscillation controller and buffer volume housing for a cryorefrigerator of the kind having at least one cooling tube, a oscillation controller coupled to a cooling gas supply and exhaust to generate an oscillating compression-expansion cycle, at least one reservoir to contain an expanding cryogen gas, at least one orifice for the movement and phasing of the gas to and from the reservoir, and a regenerator for absorbing heat temporarily and reversibly, comprising:

an integrated pressure oscillation controller and buffer volume housing coupled to the at least one cooling tube, the regenerator, and the cooling gas supply and exhaust, comprising a body having a chamber therein containing the pressure oscillation controller and at least one other chamber forming the at least one reservoir.

12. The housing of claim 11, in which there are at least a first reservoir and a second reservoir contained within the body of the housing.

13. The housing of claim 11, in which there are at least a first reservoir and a second reservoir, and wherein at least one of the first reservoir and second reservoirs is contained in the body, and the other is external to the body in gas-tight communication therewith.

14. The housing of claim 11, in which the pressure oscillation controller comprises a rotary valve rotated by a motor.

15. The housing of claim 14, in which the rotary valve is in a valve chamber in the body.

16. The housing of claim 14, in which the motor is in a motor chamber in the body.

17. The housing of claim 11, further comprising at least one orifice in close proximity to at least one reservoir.

18. The housing of claim 17, further comprising at least one flow channel connecting the orifice to at least one reservoir.

19. The housing of claim 11, further comprising at least one flow channel connecting at least one reservoir to the pressure oscillation controller.

20. A two-stage cryorefrigeration apparatus of the kind having a first cooling stage and a second cooling stage, said first cooling stage having a first stage temperature which is higher than a second stage temperature of said second cooling stage; each of the first cooling stage and second cooling stage comprising a cooling tube, regenerator and heat sink; an oscillation controller coupled to a cooling gas supply and exhaust to generate an oscillating compression-expansion cycle, at least one reservoir to contain an expanding cryogen gas, at least one orifice for the movement and phasing of the gas to and from the reservoir, the apparatus comprising:

and integrated pressure oscillation controller and buffer volume housing coupled to the first cooling stage, the second cooling stage, and the cooling gas supply and exhaust, comprising a body having a chamber therein containing the pressure oscillation controller and at least one other chamber forming the at least one reservoir.

21. The cryorefrigeration apparatus of claim 20, in which there are at least a first reservoir and a second reservoir contained within the body of the housing.

22. The cryorefrigeration apparatus of claim 20, in which there are at least a first reservoir and a second reservoir, and wherein at least one of the first reservoir and second reservoirs is contained in the body, and the other is external to the body in gas-tight communication therewith.

23. The cryorefrigeration apparatus of claim 20, in which the pressure oscillation controller comprises a rotary valve rotated by a motor.

24. The cryorefrigeration apparatus of claim 23, in which the rotary valve is in a valve chamber in the body.

25. The cryorefrigeration apparatus of claim 23, in which the motor is in a motor chamber in the body.

26. The cryorefrigeration apparatus of claim 20, in which the buffer volume housing further comprises at least one orifice in close proximity to at least one reservoir.

27. The cryorefrigeration apparatus of claim 26, in which the buffer volume housing further comprises at least one flow channel connecting the orifice to at least one reservoir.

28. The cryorefrigeration apparatus of claim 20, in which the buffer volume housing further comprises at least one flow channel connecting at least one reservoir to the pressure oscillation controller.

29. A three-stage cryorefrigeration apparatus, of the kind having a first cooling stage, a second cooling stage, and a third cooling stage, said first cooling stage having a first stage temperature which is higher than a second stage temperature of said second cooling stage and said third stage having a third stage temperature which is lower than the second stage temperature; each of the first cooling stage, second cooling stage and third cooling stage comprising a cooling tube, regenerator and heat sink; an oscillation controller coupled to a cooling gas supply and exhaust to generate an oscillating compression-expansion cycle, at least one reservoir to contain an expanding cryogen gas, at least one orifice for the movement and phasing of the gas to and from the reservoir, the apparatus comprising:

an integrated pressure oscillation controller and buffer volume housing coupled to the first cooling stage, the second cooling stage, the third cooling stage, and the cooling gas supply and exhaust, comprising a body having a chamber therein containing the pressure oscillation controller and at least one other chamber forming the at least one reservoir.

30. The cryorefrigeration apparatus of claim 29, in which there are at least a first. reservoir, a second reservoir and a third reservoir contained within the body of the housing.

31. The cryorefrigeration apparatus of claim 29, in which there are at least a first reservoir, a second reservoir and a third reservoir, and wherein at least one of the first reservoir, second reservoir, and third reservoir is contained in the body, and at least one of the other reservoirs is external to the body in gas-tight communication therewith.

32. The cryorefrigeration apparatus of claim 29, in which the pressure oscillation controller comprises a rotary valve rotated by a motor.

33. The cryorefrigeration apparatus of claim 32, in which the rotary valve is in a valve chamber in the body.

34. The cryorefrigeration apparatus of claim 32, in which the motor is in a motor chamber in the body.

35. The cryorefrigeration apparatus of claim 29, in which the buffer volume housing further comprises at least one orifice in close proximity to at least one reservoir.

36. The cryorefrigeration apparatus of claim 35, in which the buffer volume housing further comprises at least one flow channel connecting the orifice to at least one reservoir.

37. The cryorefrigeration apparatus of claim 29, in which the buffer volume housing further comprises at least one flow channel connecting at least one reservoir to the pressure oscillation controller.

* * * * *